US005938058A

United States Patent [19]

Kim

[11] Patent Number: 5,938,058

[45] Date of Patent: Aug. 17, 1999

[54] SEGMENTED MULTI-PURPOSE PORTABLE CONTAINER

[76] Inventor: Cha Sun Kim, 748 Catalina #309, Los Angeles, Calif. 90005

[21] Appl. No.: 09/110,467

[22] Filed: Jul. 6, 1998

[51] Int. Cl.[6] ..... B65D 6/24

[52] U.S. Cl. ..... 220/4.26; 206/577

[58] Field of Search ..... 206/577, 443, 206/362.1, 486; 220/4.26, 4.27, 501, 23.83, 23.86, 759, 770, 916

[56] References Cited

U.S. PATENT DOCUMENTS

| | | | |
|---|---|---|---|
| 3,052,246 | 9/1962 | Beard | 220/916 |
| 3,881,868 | 5/1975 | Duke | 206/486 |
| 4,997,629 | 3/1991 | Marchand et al. | 206/362.1 |
| 5,277,328 | 1/1994 | Tocco | 220/4.26 |
| 5,575,848 | 11/1996 | Chedville | 220/501 |
| 5,630,505 | 5/1997 | Garcia | 206/362.1 |

*Primary Examiner*—Stephen Castellano
*Attorney, Agent, or Firm*—Eugene Oak

[57] ABSTRACT

A segmented multi-purpose container having an upper segment, an intermediate segment, and a lower segment. Each of the upper and lower segments has an opening at one end that defines a chamber within each segment. The upper and lower segments are removably attachable to the intermediate segment at opposite ends thereof, wherein the chambers of both the upper and lower segments are enclosed when they are attached to the intermediate segment. Apertures intended to accommodate various articles are placed on the upper surface of the intermediate segment, wherein the articles are secured within the container when the upper and lower segments are attached to the intermediate segment. Intermediate segments with varying arrangements of apertures may be interchanged to allow the container to accommodate various articles.

18 Claims, 3 Drawing Sheets

SEGMENTED MULTI-PURPOSE PORTABLE CONTAINER

BACKGROUND OF THE INVENTION

1. Field of the Invention

The present invention pertains generally to the field of portable containers for small miscellaneous articles, and particularly to a container with interchangeable segments allowing the container to securely accommodate various articles.

2. Description of the Prior Art

Prior art in the field of portable containers teach many containers varying in both function and design. Containers having a hinged enclosure wherein articles are stored have been extensively disclosed in the prior art. Containers having an enclosure enclosable by a lid or cap have also been disclosed. These types of containers taught by the prior art are often limited in the types of articles they may securely accommodate. Moreover, the prior art does not teach a portable container as taught by the present invention. Consequently, the primary object of the present invention is to provide a portable container that is able to securely accommodate a variety of articles.

Another object of the present invention is to provide a portable container that is not unnecessarily complicated to operate.

Yet another object of the present invention is to provide a portable container that is relatively inexpensive to manufacture.

A further object of the present invention is to provide a portable container that is easily cleaned due to its readily accessible inner and outer surfaces.

SUMMARY OF THE INVENTION

The portable container of the present invention comprises an upper segment having an opening located at an end thereof, an intermediate segment having an upper and lower portion, and a lower segment having an opening located at an end thereof. The opening of the upper segment is removably attachable to the upper portion of the intermediate segment, and the opening of the lower segment is removably attachable to the lower portion of the intermediate segment. A plurality of apertures is placed on the surface of the upper portion and extends through the intermediate segment. These apertures accommodate various articles, and the intermediate segment is interchangeable with other intermediate segments having varying arrangements of apertures to accommodate varying articles. The upper and lower segments of the portable container may be interchanged with others of varying lengths in order to provide a portable container that can be readily sized to fit any application. A handle is removably attached to the upper segment to facilitate its use as a liquid receptacle. In addition, because the segments are detachable, all surfaces of the portable container are readily accessible and thus easily cleaned.

These together with other objects of the invention are explained clearly in the claims annexed to and forming a part of this disclosure. For a better understanding of the invention, its operating advantages and the specific objects attained by its use, reference should be made to the accompanying drawings in which there are illustrated preferred embodiments of the invention.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 1:
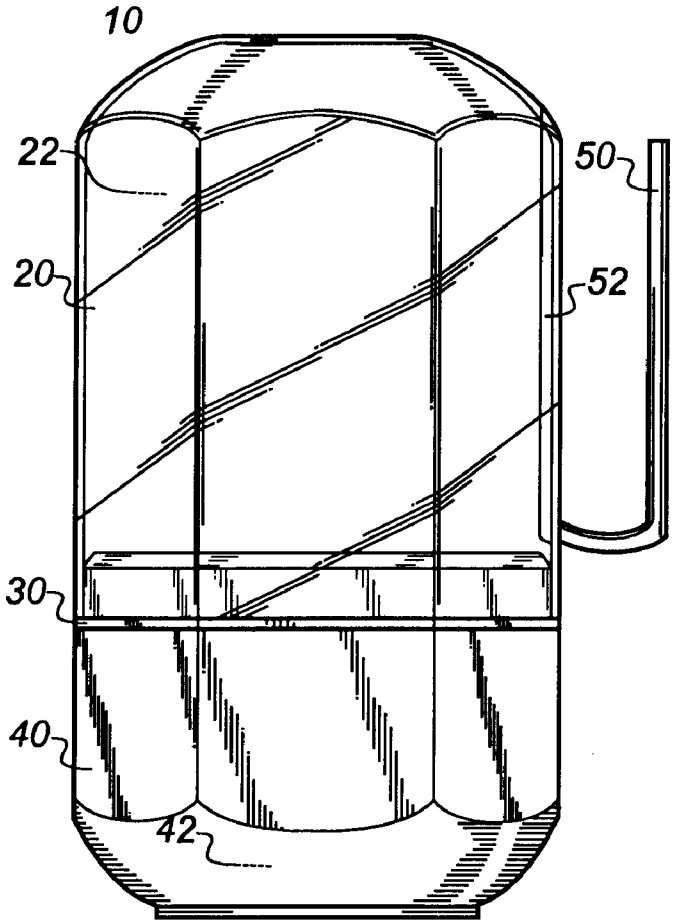
FIG. 1 is a front view of the present invention.
Figure 2:
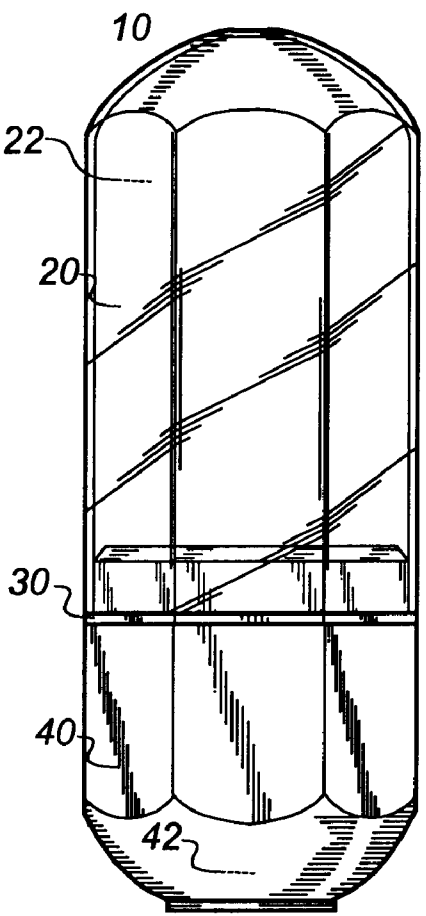
FIG. 2 is a left side elevational view of the present invention.
Figure 3:
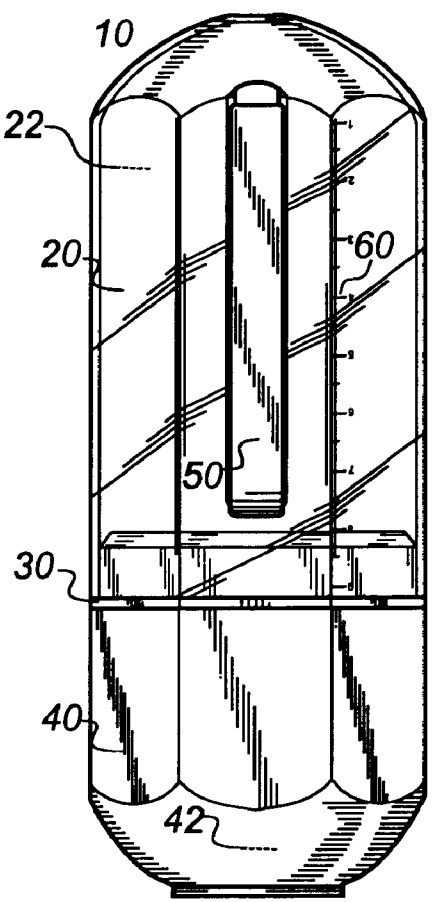
FIG. 3 is a right side elevational view of the present invention.
Figure 6:
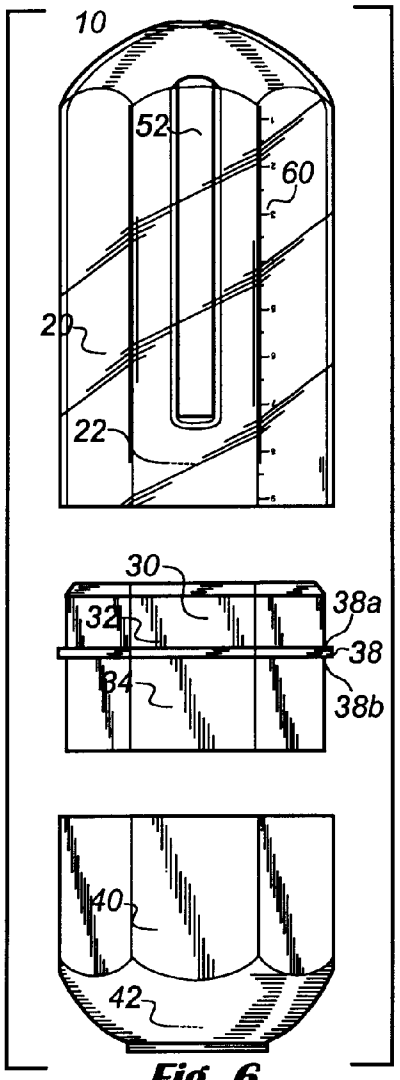
FIG. 6 is an exploded right side elevational view of the present invention.
Figure 5:
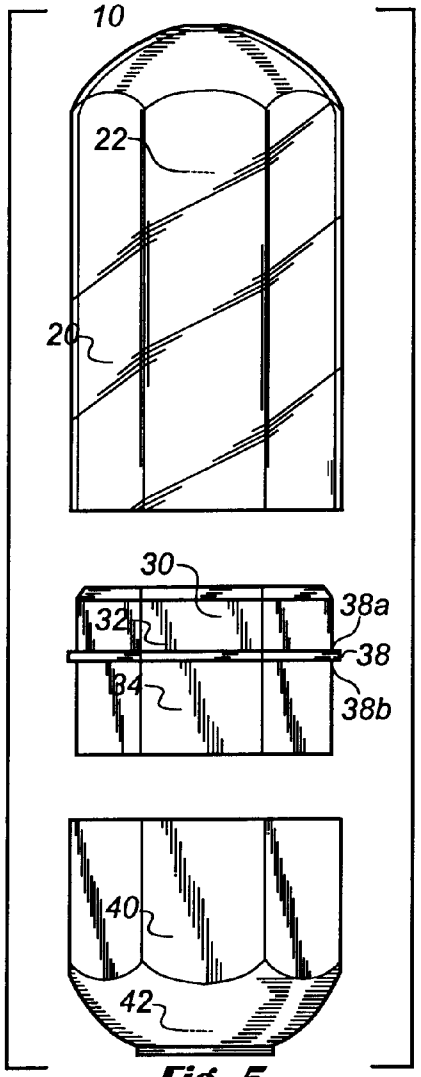
FIG. 5 is an exploded left side elevational view of the present invention.
Figure 4:
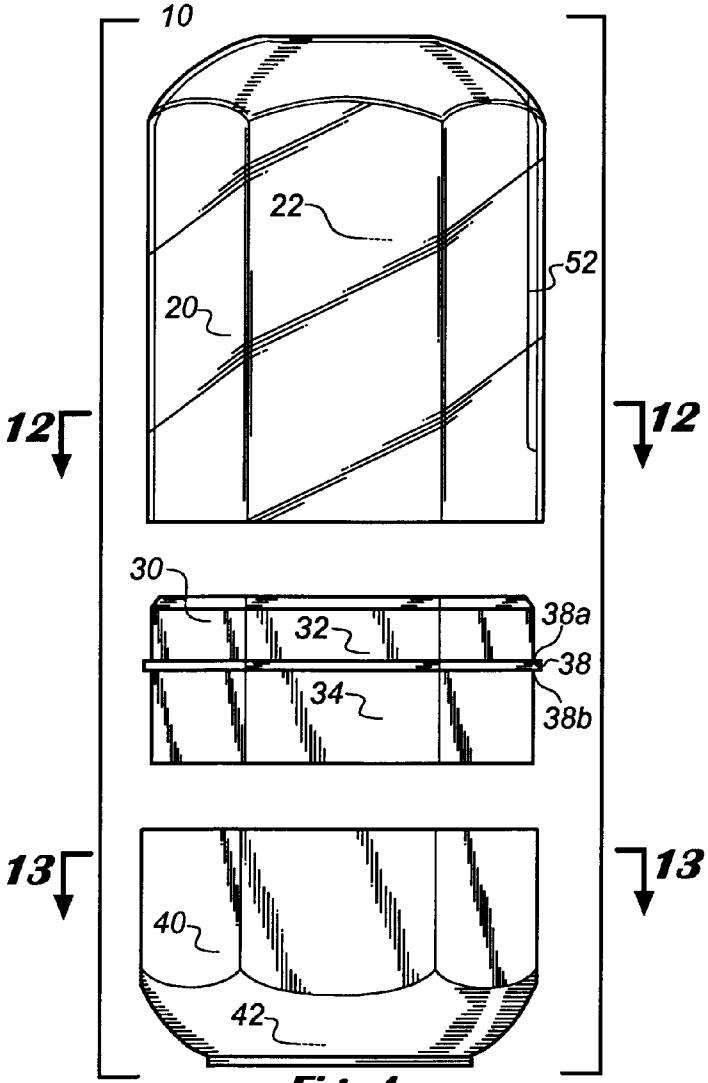
FIG. 4 is an exploded front view of the present invention.

Referring to FIG. 1, FIG. 2, and FIG. 3, the portable container 10 disclosed by the present invention has an upper segment 20, an intermediate segment 30, and a lower segment 40. Referring to FIG. 4, FIG. 5, and FIG. 6, the intermediate segment 30 further has an upper portion 32 and a lower portion 34, wherein the upper and lower portions 32 and 34 are located at opposite ends of the intermediate segment 30. A first opening is lo ted at an end of the upper segment 20 that defines a firs chamber 22 within the upper segment 20. A second opening is also located at an end of the lower segment 40 that defines a second chamber 42 within the lower segment 40.

The upper segment 20 is removably attachable and detachable to the intermediate section 30. When the upper segment 20 is positioned atop the intermediate section 30, the upper portion 32 extends through the first opening and into the first chamber 22 and form a sufficiently tight engagement between the upper portion 32 and the first opening of the upper segment 20 so as to prevent the accidental removal of the upper segment 20 from the engagement therebetween. The first chamber 22 is enclosed when the upper segment 20 is properly attached to the intermediate section 30.

The lower segment 40 is removably attachable and detachable to the intermediate section 30. When the lower segment 40 is positioned beneath the intermediate section 30, the lower portion 34 extends through the second opening and into the second chamber 42 an forms a sufficiently tight engagement between the lower portion 34 and the second opening of the lower segment 40 so as to prevent the accidental removal of the lower segment 40 from the engagement therebetween. The second chamber 42 is enclosed when the lower segment 40 is properly attached to the intermediate section 30.

Figure 7:
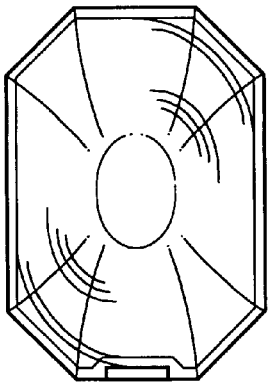
FIG. 7 is a top plan view of the present invention.
Figure 8:
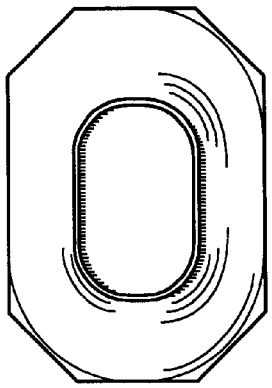
FIG. 8 is a bottom plan view of he present invention.
Figure 11:
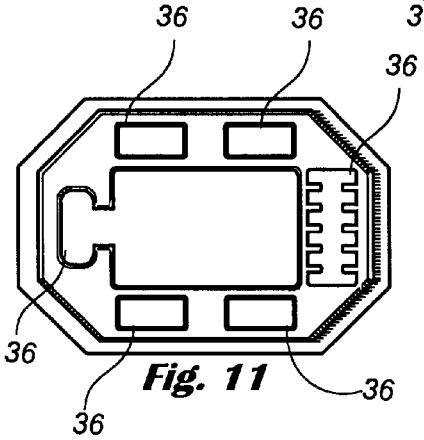
FIG. 11 is a top plan view of the intermediate segment of a third embodiment of the present invention.
Figure 12:
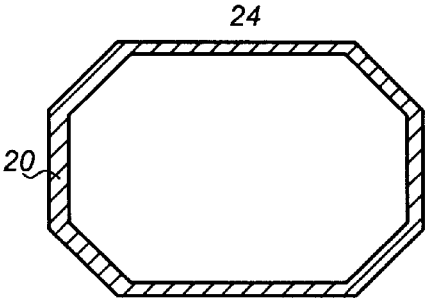
FIG. 12 is a cross-sectional view of the upper segment taken along line 12—12 of FIG. 4.
Figure 13:
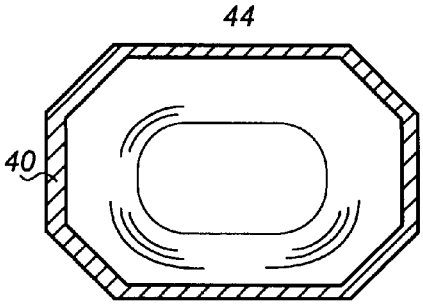
FIG. 13 is a cross-sectional vie of the lower segment taken along line 13—13 of FIG. 4.

Referring to FIG. 12, the upper segment 20 has a first cross-sectional profile 24. Refer ring to FIG. 13, the lower segment 40 has a second cross-sectional profile 44. The first and second cross-sectional profiles 24 and 44 are substantially equivalent. Referring to FIG. 9, FIG. 10, FIG. 11, FIG. 4, FIG. 5, and FIG. 6, it can be ascertained that a third cross-sectional profile of the intermediate section 30 is lesser than but proportional to a fourth cross-sectional profile of a protruding section 38 enlarged radially and extending circumferentially about the intermediate segment 30. The fourth cross-sectional profile is substantially equivalent to the first and second cross-sectional profiles 24 and 44, as can be seen from FIG. 7 and FIG. 8.

The protruding section 38 protruding from the intermediate segment 30 defines an upper shoulder 38*a* and a lower shoulder 38*b* between the intermediate segment 30 and protruding section 38. The upper shoulder 38*a* abuts the first opening of the upper segment 20 in a flush manner with respect to the first and fourth cross-sectional profiles 24 and 44. The lower shoulder 38*b* abuts the second opening of the lower segment 40 in a flush manner with respect to the second and fourth cross-section profiles. In this manner, when the three segments 20, 30, and 40 are attached together, the form one continuous portable container 10 with the ends f each segment 20, 30, and 40 flush to each other.

Figure 9:
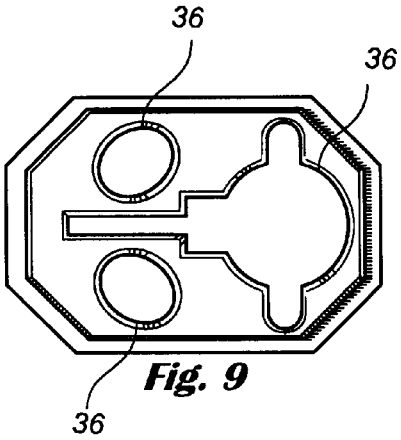
FIG. 9 is a top plan view of the intermediate segment of a first embodiment of the present invention.
Figure 10:
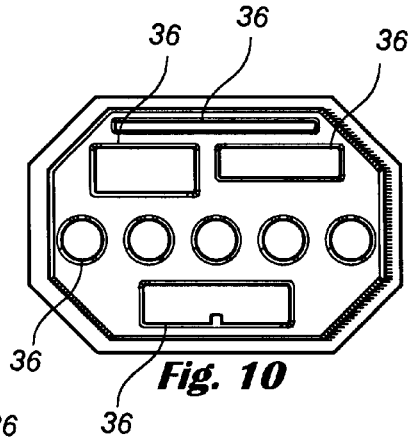
FIG. 10 is a top plan view of the intermediate segment of a second embodiment of the present invention.

Referring to FIG. 9, FIG. 10, and FIG. 11, a plurality of apertures 36 are placed on said upper portion 32 of the intermediate section and extends through said intermediate section 30. The plurality of apertures 36 are arranged and shaped in such a way as to accommodate various articles. Referring to FIG. 9, in a first embodiment, the plurality of apertures 36 are arranged and shaped in order to simultaneously accommodate a toothbrush, a razor blade, a comb, and a tube of toothpaste. Referring to FIG. 10, in a second embodiment, the plurality of apertures 36 are arranged and shaped in order to simultaneously accommodate a plurality of pencils, a compass, a ruler, a pencil sharpener, and an eraser. Referring to FIG. 11, a third embodiment, the plurality of apertures 36 are arranged and shaped in order to simultaneously accommodate an eyelid curler, a plurality of nail files, a plurality of eye makeup pencils, and a nail clipper.

Referring to FIG. 1, FIG. 3, and FIG. 4, a handle 50 is slideably and removably mounted to the upper segment 20. An elongated recession 52 is longitudinally placed along a side of the upper segment 20 into which an engaging means of the handle 50 is slideably and securably inserted. This allows the handle 50 to be removed during travel and inserted into the recession 52 to facilitate the use of the upper segment 20 as a receptacle for liquid. To further facilitate the use of the upper segment 20 as a receptacle for liquid, measurement indicia and corresponding hash marks 60 may be longitudinally placed along the length of the upper segment 20. The indicia accurately indicate the volume of the first chamber below the corresponding hash marks. Therefore, when the upper segment 20 is positioned with the first opening facing upward, the indicia and hash marks 60 start from the bottom and extend to the top of the segment 20.

In a preferred embodiment of the present invention, the first cross-sectional profile 24, the second cross-sectional profile 44, the third and the fourth cross-sectional profiles are octagonal. The upper segment 20 may be made of translucent material to expose the articles accommodated in the portable container 10.

In alternate embodiments of the present invention, the upper and lower segments 20 and 10 are replaceable by corresponding upper and lower segments of differing lengths in order to properly accommodate articles of differing lengths. Especially lengthy articles may require that either the upper or lower segment 20 and 40 be replaced by a lengthier counterpart in order to fit the article within the portable container 10.

What is claimed as being new and therefore desired to be protected by Letters Patent of the United States is as follows:

1. A portable container comprising:

a) an upper segment having a first opening at an end thereof defining a first chamber therein;

b) a lower segment having a second opening at an end thereof defining a second chamber therein;

c) an intermediate segment having an upper and lower portion disposed at opposite ends thereof;

1) said upper portion removably attachable to said opening of said upper segment and enclosing said first chamber when said upper segment is attached thereto;

2) said lower portion removably attachable to said opening of said lower segment and enclosing said second chamber when said lower segment is attached thereto;

3) a plurality of apertures disposed upon said upper portion and extending through said intermediate segment, said apertures arranged and shaped to accommodate various articles d) measurement indicia and corresponding hash marks disposed longitudinally upon said upper segment, wherein said indicia accurately indicate the volume of said first chamber below said corresponding hash marks with respect to said first opening of said upper segment.

2. A portable container as mentioned in claim 1, wherein said upper segment is made of translucent material.

3. A portable container as mentioned in claim 1, wherein:

a) said upper portion extends through said first opening and into said first chamber forming a sufficiently tight engagement therebetween so as to prevent accidental removal of said upper segment from said intermediate segment;

b) said lower portion extends through said second opening and into said second chamber forming a sufficiently tight engagement therebetween so as to prevent accidental removal of said lower segment from said intermediate segment.

4. A portable container as mentioned in claim 1, wherein said upper and lower segments are replaceable by corresponding upper and lower segments of differing lengths in order to properly accommodate articles of differing lengths.

5. A portable container comprising:

a) an upper segment having a first opening at an end thereof defining a first chamber therein, and having a predetermined first cross-sectional profile;

1) a handle slideably and removably mounted upon said upper segment;

(a) an elongated recession longitudinally disposed upon said upper segment;

(b) said handle having an elongated member slideably and securably inserted into said elongated recession;

b) a lower segment having a second opening at an end thereof defining a second chamber therein, and having a second cross-sectional profile substantially equivalent to said first cross-sectional profile of said upper segment;

c) an intermediate segment having an upper and lower portion disposed at opposite ends thereof, and a third cross-sectional profile proportional to but lesser than said first and second cross-sectional profiles;

1) said upper portion removably attachable to said opening of said upper segment and enclosing said first chamber when said upper segment is attached thereto;

2) said lower portion removably attachable to said opening of said lower segment and enclosing said second chamber when said lower segment is attached thereto;

3) a protruding section enlarged radially and extending circumferentially about said intermediate segment defining an upper and lower shoulder between said intermediate segment and protruding section;

(a) said protruding section having a fourth cross-sectional profile substantially equivalent to said first and second cross-sectional profile;

(b) said upper shoulder abutting said first opening of said upper segment in a flush manner with respect to said first and fourth cross-sectional profiles;

(c) said lower shoulder abutting said second opening of said lower segment in a flush manner with respect to said second and fourth cross-sectional profiles;

4) a plurality of apertures disposed upon said upper portion and extending through said intermediate segment, said apertures arranged and shaped to accommodate various articles.

6. A portable container as mentioned in claim 5, wherein said first, second, third, and fourth cross-sectional profiles are octagonal.

7. A portable container as mentioned in claim 5, wherein measurement indicia and corresponding hash marks are longitudinally disposed upon said upper segment, wherein said indicia accurately indicate the volume of said first chamber below said corresponding hash marks with respect to said first opening of said upper segment.

8. A portable container as mentioned in claim 5, wherein said upper segment is made of translucent material.

9. A portable container as mentioned in claim 5, wherein:

a) said upper portion extends through said first opening and into said first chamber forming a sufficiently tight engagement therebetween so as to prevent accidental removal of said upper segment from said intermediate segment;

b) said lower portion extends through said second opening and into said second chamber forming a sufficiently tight engagement therebetween so as to prevent accidental removal of said lower segment from said intermediate segment.

10. A portable container as mentioned in claim 5, wherein said plurality of apertures disposed upon said upper portion are arranged and shaped to simultaneously accommodate a toothbrush, a razor blade, a comb, and a tube of toothpaste.

11. A portable container as mentioned in claim 5, wherein said plurality of apertures disposed upon said upper portion are arranged and shaped to simultaneously accommodate a plurality of pencils, a compass, a ruler, a pencil sharpener, and an eraser.

12. A portable container as mentioned in claim 5, wherein said plurality of apertures disposed upon said upper portion are arranged and shaped to simultaneously accommodate an eyelid curler, a plurality of nail files, a plurality of eye makeup pencils, and a nail clipper.

13. A portable container as mentioned in claim 5, wherein said upper and lower segments are replaceable by corresponding upper and lower segments of differing lengths in order to properly accommodate articles of differing lengths.

14. A portable container comprising:

a) an upper segment having a first opening at an end thereof defining a first chamber therein;

1) a handle slideably and removably mounted upon said upper segment;

(a) an elongated recession longitudinally disposed upon said upper segment;

(b) said handle having an elongated member slideably and securably inserted into said elongated recession;

b) a lower segment having a second opening at an end thereof defining a second chamber therein;

c) an intermediate segment having an upper and lower portion disposed at opposite ends thereof;

1) said upper portion removably attachable to said opening of said upper segment and enclosing said first chamber when said upper segment is attached thereto;

2) said lower portion removably attachable to said opening of said lower segment and enclosing said second chamber when said lower segment is attached thereto;

3) a plurality of apertures disposed upon said upper portion and extending through said intermediate segment, said apertures arranged and shaped to accommodate various articles.

15. A portable container as mentioned in claim 14, wherein measurement indicia and corresponding hash marks are longitudinally disposed upon said upper segment, wherein said indicia accurately indicate the volume of said first chamber below said corresponding hash marks with respect to said first opening of said upper segment.

16. A portable container as mentioned in claim 14, wherein said upper segment is made of translucent material.

17. A portable container as mentioned in claim 14, wherein:

a) said upper portion extends through said first opening and into said first chamber forming a sufficiently tight engagement therebetween so as to prevent accidental removal of said upper segment from said intermediate segment;

b) said lower portion extends through said second opening and into said second chamber forming a sufficiently tight engagement therebetween so as to prevent accidental removal of said lower segment from said intermediate segment.

18. A portable container as mentioned in claim 14, wherein said upper and lower segments are replaceable by corresponding upper and lower segments of differing lengths in order to properly accommodate articles of differing lengths.

* * * * *